United States Patent [19]

Newhouse et al.

[11] Patent Number: 4,728,136

[45] Date of Patent: Mar. 1, 1988

[54] GRAPPLE AND LIFT BEAMS FOR HIGH INTEGRITY CONTAINERS FOR RADIOACTIVE WASTE

[75] Inventors: Harold L. Newhouse, Gaithersburg; Charles W. Mallory, Severna Park, both of Md.

[73] Assignee: Westinghouse Electric Corp., Pittsburgh, Pa.

[21] Appl. No.: 701,048

[22] Filed: Feb. 12, 1985

[51] Int. Cl.[4] ..... B66C 1/00; G21F 5/00

[52] U.S. Cl. ..... 294/68.3; 294/81.1; 294/81.5; 250/506.1; 376/272

[58] Field of Search ..... 376/272, 260; 294/81.5, 294/119.2, 81.1, 68.3, 81.51; 220/314, 318, 323, 324; 414/146, 288; 250/506.1, 507.1, 522.1; 206/549

[56] References Cited

U.S. PATENT DOCUMENTS

| | | | |
|---|---|---|---|
| 4,045,071 | 8/1977 | Dunstan | 294/68.3 |
| 4,201,511 | 5/1980 | Charles | 294/81.1 |
| 4,241,846 | 12/1980 | Murphy | 220/318 |
| 4,244,615 | 1/1981 | Brown | 294/81.1 |
| 4,341,495 | 7/1972 | Del'Acqua | 294/81.1 |
| 4,358,421 | 11/1982 | Jabsen | 376/271 |
| 4,542,928 | 9/1985 | Fowler, Jr. | 294/81.1 |
| 4,563,031 | 1/1986 | Kishimoto et al. | 294/81.51 |

FOREIGN PATENT DOCUMENTS

| | | | |
|---|---|---|---|
| 1203179 | 1/1960 | France | 376/272 |
| 0222791 | 12/1984 | Japan | 376/272 |
| 0140562 | 1/1961 | U.S.S.R. | 294/81.51 |
| 0196621 | 5/1967 | U.S.S.R. | 294/68.3 |

OTHER PUBLICATIONS

"Waste Container Assembly with Lifting Device", WE 52,120, pp. 1–4, FIGS. 1–3, (no date).

"Waste Containers for Decommissioning", DOE, Powers, pp. 39–40a, 67–68, 9/82.

*Primary Examiner*—David H. Brown

*Assistant Examiner*—Daniel Wasil

[57] ABSTRACT

Disclosed is a container assembly for the storage and disposal of material containing low-level nuclear wastes particularly suited for remote handling. A waste container has lifting lugs onto which a reusable grapple beam, made of rectangular tubing joined to form a polygon, is placed and attached to the lifting lugs by hooks. Screw jacks are used to tension the assembly and prevent inadvertent unlatching. The container is filled through the interior of the polygon into an opening in the container. The container may be filled, capped, handled, and the grapple beam removed by remote operations.

4 Claims, 4 Drawing Figures

GRAPPLE AND LIFT BEAMS FOR HIGH INTEGRITY CONTAINERS FOR RADIOACTIVE WASTE

BACKGROUND OF THE INVENTION

Nuclear power plants, research laboratories, and nuclear fuel processors generate radioactive waste materials as a by-product of their operations. These low-level nuclear waste-containing materials can be disposed of using proper burial procedures that sufficiently isolate the material from the soil.

One method is to solidify the waste in a solid form such as by adding cement. This approach is complicated by the need to add ingredients to prevent the waste from dissolving out of the cement, as well as by the volume increase caused by cement.

An alternative that does not increase the volume of material to be disposed is to use a container capable of isolating the material. High integrity containers have been adopted by the nuclear industry as a method of disposing of radioactive waste in a dewatered form without solidification or the use of absorber.

An important requirement in the design of containers for the disposal of nuclear waste-containing material is the minimization of radiation exposure to personnel. Exposure is most likely to occur during handling events if specific design precautions are not taken to avoid proximity to the waste material.

One of these events is when the container, after filling with waste, must be connected to a crane or other lifting means for placement into a shipping cask for transport to the disposal site.

Another event is when the container lid is placed on and secured to the waste-filled container. At this point the radiation problem is particularly severe because the container opening through which the waste was inserted is unshielded and therefore not attenuated.

Completion of these steps by remote procedures is highly desirable, but must be accomplished so as not to interfere or complicate other procedures. It is especially important that providing for the remote completion of one step does not increase the exposure time or radiation dose in completing another task. Required access to needed container parts cannot be complicated. In addition, contamination of handling equipment and the container exterior must not become likely because of remote handling procedures.

SUMMARY OF THE INVENTION

A container assembly that includes a waste container and grapple beam allows for remote handling of the waste container but does not interfere with remote filling or sealing of the waste with a screw-type top. While empty, a triangular grapple beam constructed of three joined box beams is attached to container lifting lugs, and tension is applied therebetween to secure the connection. The size of the triangular grapple beam is such that the container opening is readily accessible for filling all container and remote sealing of the top. Sockets in the grapple beam allow remote latching and unlatching of the lifting means for the assembly.

DESCRIPTION OF THE PREFERRED EMBODIMENT

Figure 1:
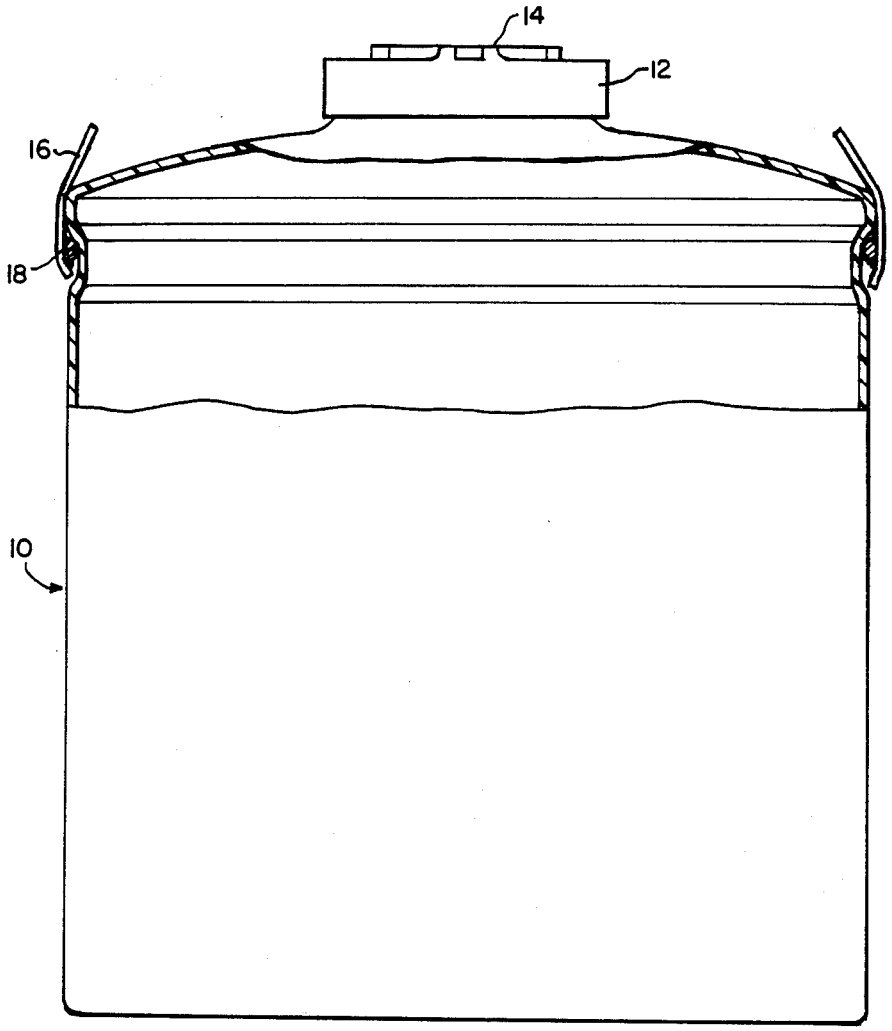
FIG. 1 is a cross-section elevational view of the waste container without the grapple beam in place.

Referring to FIG. 1, a waste container 10 is constructed of a material such as plastic which is not susceptible to chemical attack from the burial environment or the waste material. Plastics found to be acceptable in most radioactive waste container applications are polyethylene, polypropylene, and fiberglass. To reduce the possibility of a breach of container integrity, the waste container is made of one continuous piece with no seams or joints.

The waste is sealed into the container 10 by means of a screw-type top 12 also made of plastic. The top has ridges 14 for remote mechanical turning.

A plurality of lifting lugs 16 are provided in sufficient strength and number, in the present embodiment six, to lift the container fully loaded with waste and sustain an acceleration of 3 g. This is accomplished through the use of a lift ring 18 which distributes the load around the periphery of the container.

Figure 2:
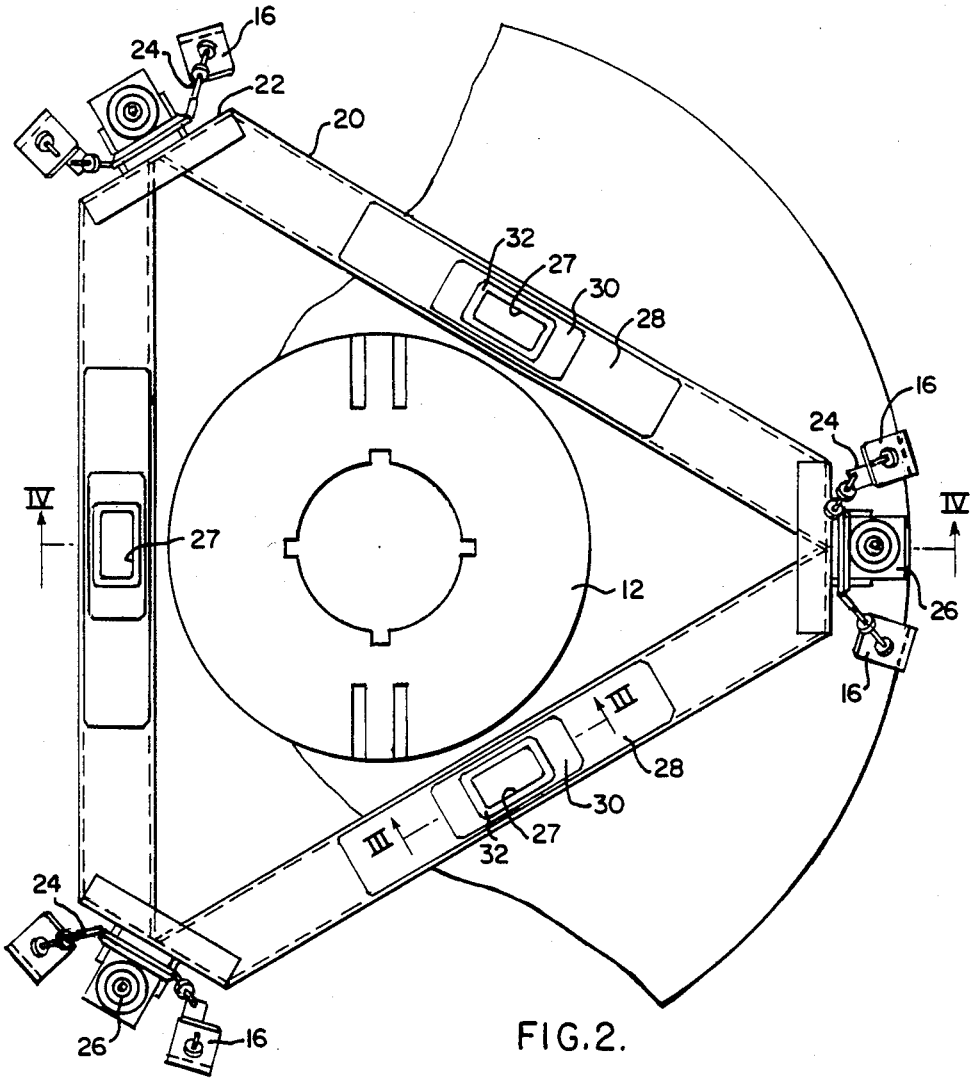
FIG. 2 is a top view of the grapple beam as it would be placed on the waste container.

Referring to FIG. 2, a top view of the grapple beam is shown as it would appear in place on the waste container. The grapple beam is made of at least three members 20 which along with the tie pieces 22 joining the ends of the members 20 form a polygon.

The grapple beam members 20 are preferably constructed from steel tubing that has a rectangular cross-section. The tie pieces 22 that join the ends of the members are, in the preferred embodiment, made from steel channel stock. The members have the ends mitered to form a common plane on their ends and the tie pieces are attached such as by welding. The flanges of the channel stock are oriented parallel to the common plane shared by two faces of the grapple beam members, that is in the preferred embodiment along the top and bottom of the members.

The grapple beam members 20 and tie pieces 22 are sized so that the interior of the polygon formed has sufficient clearance for the waste container top 12 to be sealed by screwing on without interference.

Attached to the tie pieces 22 are means for attaching and holding the container lifting lugs, such as hooks 24. The hooks 24 are flexibly attached to the tie pieces 22 and engage the lifting lugs 16 of the waste container.

Also attached to the tie pieces 22 are tensioning means such as a screw jack 26. Only a first portion of the tensioning means is fixed to the tie piece, a second portion of it is capable of moving relative to the first portion and the tie piece. Upon operation of the screw jacks, the second portions bear against the container 10 to provide tension between the grapple beam and the lifting lugs. This tension prevents the container from becoming disengaged from the grapple beam when the assembly is subject to shock loading or transportion vibrations.

Sockets are provided in the grapple beams for remotely engaging and latching a lifting device (not shown) used to handle and move the container assembly and its contents. The sockets are rectangular holes 27 in the member faces opposite the container 10, that is the top faces of the grapple beam members.

The apertures are located near the midpoint of the grapple beam member. The apertures are oriented such that the long sides of the rectangular apertures are parallel to the length of the grapple beam member containing the aperture.

Figure 3:
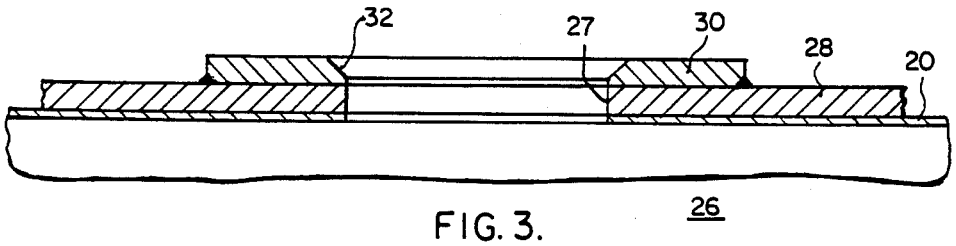
FIG. 3 is a sectional view through one of the grapple beam sockets along line III—III.

A cross sectional view of the portion of the member 20 having the rectangular aperture 27 is shown in FIG. 3. A reinforcing plane 28 larger than the aperture 27 is fixed to the member face containing the aperture. The reinforcing plane is located on the member face with its edges parallel to the aperture edges and centered with edges equidistantly spaced, shown in FIG. 2.

The reinforcing plate has an opening that allows access to the aperture 27 that forms the socket. As shown in FIG. 3, a second reinforcing plate 30 may also be used. This second plate is smaller than the first reinforcing plate 28, but has the same relationship to the grapple beam member 20 and its aperture 27 as the first plate, similarly contains an opening, and is attached to the first plate.

The opening of the second reinforcing plate 30 has a chamfer 32 around the opening to facilitate insertion of the lifting device.

Figure 4:
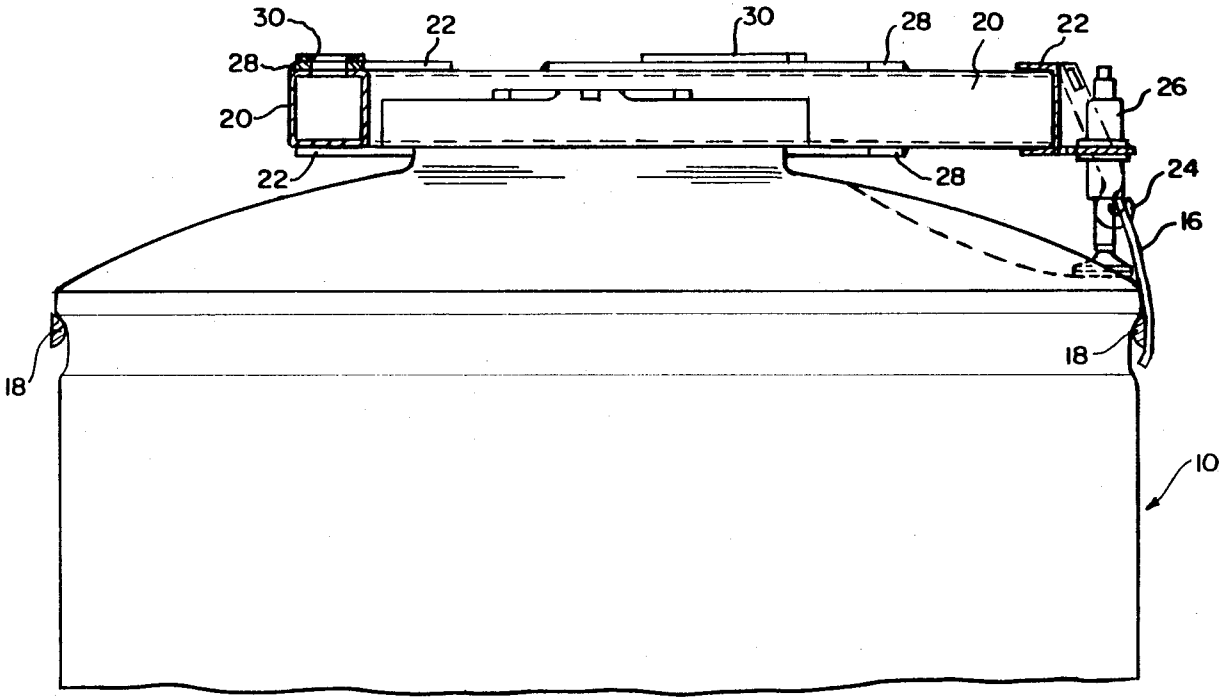
FIG. 4 is an elevational view of the waste container with the grapple beam in place showing the beam in cross-section along line IV—IV.

In operation, the empty waste container 10 with its top removed is fitted with the grapple beam so that the tie pieces 22 are adjacent the lifting lugs 16 and next to the hooks 24. The hooks are then attached to the lifting lugs as shown in FIG. 4. The screw jack 26 is extended at each location until sufficient tension is applied between the container and grapple beam deforming the upper portion of the container 10. The above is accomplished without radiation exposure.

Waste material is then poured into the container through its opening. The container top 12 is lifted and secured onto the container using a remote handling device by the top ridges 14. A lifting device, remotely controlled, is positioned above the container assembly and lowered until it engages and latches onto the grapple beam by the sockets 27.

The lifting device typically will have a protrusion that is larger than the aperture's minor axis but smaller than the aperture's major axis. The protrusion is inserted when aligned with the major axis, rotate 90° and the container may then be lifted.

After handling is completed, the lifting device is disengaged and removed. The grapple beam is removed by using a remote tool to turn the screw jack and relieve the tension allowing the hook to disengage from the lift lugs and then lifting the grapple beam from the container. The grapple beam can then be reused.

With the grapple beam removed, the containers can be stacked without interference from any handling apparatus.

We claim:

1. A container assembly for the storage, handling, transport, and ultimate disposal of radio-active waste containing material, said container assembly comprising:

a. a waste container having a plurality of lifting lugs associated therewith capable of bearing the weight of the container and its contents and having an opening in the top of said container for the insertion of waste material, b. a top for sealing the container opening after the waste material is inserted, and c. a grapple beam having means for attaching and holding the container lifting lugs, having tensioning means for applying continuously stress between the means for attaching and holding the container lifting lugs and the lugs to prevent inadvertent release, and having sockets that can be remotely engaged and latched to lifting a device for handling the container and its contents, the grapple beam comprised of at least three members joined at their ends forming a polygon of a predetermined size such that the top can be inserted into the polygon interior and secured to the waste container.

2. The container assemby of claim 1 wherein said grapple beam members comprise tubing with a rectangular cross-section, tie pieces which comprise channel stock joining member ends together and oriented with the plane of the channel flanges parallel to the common plane shared by two faces of two grapple beam members.

3. The container assembly of claim 2 wherein said tensioning means comprises a screw jack having a first segment fastened to the tie piece and having second segment which moves relative to the first segment and bears against the container to provide tension between the grapple beam and the lifting lugs, and said sockets comprise said grapple beam members having rectangular apertures near the midpoint of the rectangular tube face opposite the container, the rectangular apertures oriented such that the long side of each aperture is parallel to the length of the grapple beam member containing the aperture.

4. The container assembly of claim 3 wherein said grapple beam member further comprises a reinforcing plate which is larger than said aperture and is fixed to the member face that has said aperture such that each edge of said plate is located with its edges substantially parallel to and equidistant from the edge of said aperture, and said reinforcing plate having an opening allowing access to said socket.

* * * * *